US011053110B2

(12) United States Patent
Lazatin et al.

(10) Patent No.: US 11,053,110 B2
(45) Date of Patent: Jul. 6, 2021

(54) RECONSTITUTION OF INDEPENDENT BEVERAGE FLOWS

(71) Applicant: BEDFORD SYSTEMS LLC, Bedford, MA (US)

(72) Inventors: Patrick Lazatin, Woburn, MA (US); Bryan Ellis Wagenknecht, Boston, MA (US); William Roger Mainwaring-Burton, Cambridge, MA (US); Linda Marie Donoghue, Boston, MA (US); Thomas Adam Sullivan, Boston, MA (US); Michael M. Martin, Mill Valley, CA (US)

(73) Assignee: BEDFORD SYSTEMS LLC, Bedford, MA (US)

( * ) Notice: Subject to any disclaimer, the term of this patent is extended or adjusted under 35 U.S.C. 154(b) by 0 days.

(21) Appl. No.: 16/362,486

(22) Filed: Mar. 22, 2019

(65) Prior Publication Data

US 2019/0292032 A1 Sep. 26, 2019

Related U.S. Application Data

(60) Provisional application No. 62/646,785, filed on Mar. 22, 2018.

(51) Int. Cl.
*B67D 1/00* (2006.01)

(52) U.S. Cl.
CPC ..... *B67D 1/0052* (2013.01); *B67D 1/0021* (2013.01); *B67D 2210/00031* (2013.01); *B67D 2210/00049* (2013.01)

(58) Field of Classification Search
CPC ..... B67D 1/0052; B67D 1/0021; B67D 2210/00031; B67D 2210/00049
USPC ..... 222/145.1, 129.1
See application file for complete search history.

(56) References Cited

U.S. PATENT DOCUMENTS

| | | | | |
|---|---|---|---|---|
| 27,112 A * | 2/1860 | Daniels | B67D 1/0021 | 222/129.1 |
| 1,261,986 A * | 4/1918 | White | B67D 1/0021 | 222/129.1 |
| 2,537,119 A * | 1/1951 | Bauerlein | B67D 1/0051 | 137/594 |
| 3,217,931 A | 11/1965 | Farrar et al. | | |

(Continued)

FOREIGN PATENT DOCUMENTS

| | | |
|---|---|---|
| JP | H07125798 A | 5/1995 |
| JP | 2013014338 A | 1/2013 |
| WO | 2014200481 A1 | 12/2014 |

OTHER PUBLICATIONS

English translation of JP 2013014338A from Espacenet (Year: 2020).*

(Continued)

*Primary Examiner* — Michael J. Melaragno
(74) *Attorney, Agent, or Firm* — Dorsey & Whitney LLP

(57) ABSTRACT

A dispensing assembly that can include first and second elements is provided. The first element can define a first outlet through which a first liquid is dispensed. The second element can define a second outlet through which a second liquid is dispensed. The first liquid can form an internal liquid stream when dispensed through the first outlet. The second liquid can form an annular liquid column around the internal liquid stream when dispensed through the second outlet.

18 Claims, 10 Drawing Sheets

(56) References Cited

U.S. PATENT DOCUMENTS 3,373,937 A * 3/1968 Yuza ..... B67D 1/1405 239/11
3,396,871 A * 8/1968 McCann ..... B67D 1/0085 141/362
3,455,332 A * 7/1969 Cornelius ..... B01F 5/0077 366/167.1
3,580,425 A * 5/1971 DeMan ..... B67D 1/0021 222/129.1
3,643,688 A 2/1972 Meinert
3,727,844 A * 4/1973 Bencic ..... B67D 1/0048 239/414
4,509,690 A * 4/1985 Austin ..... B01F 5/08 222/129.1
4,708,266 A * 11/1987 Rudick ..... B67D 1/0036 222/105
4,753,370 A * 6/1988 Rudick ..... B67D 1/0051 222/105
4,986,447 A * 1/1991 McCann ..... B67D 1/0044 222/129.1
5,000,351 A * 3/1991 Rudick ..... B67D 1/0036 222/105
5,033,651 A * 7/1991 Whigham ..... B67D 1/0051 222/1
5,129,549 A * 7/1992 Austin ..... B67D 1/0082 222/129.1
5,203,474 A * 4/1993 Haynes ..... B67D 1/0044 222/129.1
5,228,597 A * 7/1993 Low ..... B67D 1/0046 137/630.15
5,649,644 A * 7/1997 Hashimoto ..... B67D 1/0044 222/129.1
5,803,320 A * 9/1998 Cutting ..... B67D 1/0036 222/129.1
6,173,862 B1 * 1/2001 Buca ..... B67D 1/0043 222/1
6,401,197 B1 6/2002 Kondo
6,401,981 B1 * 6/2002 McCann ..... B67D 1/0042 222/129.1
6,983,863 B2 * 1/2006 Santy, Jr. ..... B67D 1/0043 222/129.1
8,074,825 B1 * 12/2011 Ziegler ..... B01F 15/0226 137/625.41
8,113,386 B2 * 2/2012 Herrick ..... A23C 9/133 141/105
8,162,177 B2 * 4/2012 Ziesel ..... B67D 1/0044 222/1
8,162,181 B2 * 4/2012 Carpenter ..... G07F 13/065 222/129.4
8,453,879 B2 * 6/2013 Carpenter ..... B67D 1/0032 222/129.4
8,807,393 B2 * 8/2014 Carpenter ..... B67D 1/0051 222/129.4
8,820,580 B2 * 9/2014 Ziesel ..... B67D 1/0044 222/129.1
9,272,817 B2 3/2016 Becker et al.
9,745,186 B2 * 8/2017 Hecht ..... B67D 1/0052
9,936,834 B2 * 4/2018 Novak ..... B65D 85/73
10,071,899 B2 * 9/2018 Mastro ..... B67D 1/0888
10,442,671 B2 * 10/2019 Hecht ..... B67D 1/0052
2004/0040983 A1 * 3/2004 Ziesel ..... B67D 1/0051 222/129.1
2005/0045655 A1 * 3/2005 Santy, Jr. ..... B67D 1/0043 222/129.1
2006/0196886 A1 * 9/2006 Fox ..... B67D 1/0044 222/129.1
2009/0230149 A1 * 9/2009 Smeller ..... B67D 1/0024 222/145.5
2014/0209629 A1 * 7/2014 Gates ..... B67D 1/0044 222/1

OTHER PUBLICATIONS

International Search Report and Written Opinion of International Application No. PCT/US2019/023579 dated Jul. 4, 2019.
Machine translation of Japanese Publication No. 2013014338.

* cited by examiner

RECONSTITUTION OF INDEPENDENT BEVERAGE FLOWS

CROSS-REFERENCE TO RELATED APPLICATION

This patent application is a non-provisional patent application of, and claims priority to, U.S. Provisional Patent Application No. 62/646,785 filed Mar. 22, 2018, titled "Reconstitution of Independent Beverage Flows," the disclosure of which is hereby incorporated by reference in its entirety.

TECHNICAL FIELD

The technology disclosed herein relates generally to beverage dispensers, and more particularly, to structures and techniques for combining independent beverage flows.

BACKGROUND

Liquid dispensers are appliances that prepare drinks for users. Often, a dispenser will include a connection to a water source, such as the plumbing of a building or an independent water reservoir, and a receiver that receives a package containing a flavoring agent. The water and the flavoring agent are mixed in the appliance before being dispensed from the appliance into the user's cup.

While many traditional systems utilized a premix method to mix the flavoring agent and water prior to dispensing, this often results in a less sterile system because the premixed solution travels through parts of the system prior to dispensing, which internal parts of the system are often difficult to clean an sterilize. Consequently, a number of systems focus on postmix processes, wherein the flavoring agent and water are combined outside of the system to prevent the internal contamination issues associated with premixing.

Postmix processes have historically combined the flavoring agent and water immediately before delivery into a cup, or concurrently as independent streams of water and flavoring agent into the cup, allowing mixing to occur in the cup. The latter option, providing independent streams of water and flavoring agent to be mixed in a cup, suffers from a number of issues including possible incomplete mixing due to insufficient pressures, turbulence, or material properties that resist easy mixing. Additionally, the sequential dispensing of independent streams is also more time consuming, noisy, and can offer a less satisfactory user experience. In contrast, combining the flavoring agent and water immediately before delivery into a cup presents additional challenges. This in-air mixing relies on precise timing and accurate flow paths to ensure consistent mixing and to ensure accurate dispensing into the desired cup and avoiding an undesirable spill.

One example traditional liquid dispenser is disclosed in U.S. Pat. No. 6,401,197 issued to Jerome L. Elkind. In this reference, a dispenser is taught, including a plurality of beverage supply sources adapted to supply a plurality of beverage constituents. The beverage mixing apparatus includes a first aperture adapted to receive the plurality of beverage constituents, a second aperture adapted to dispense a mixture of the beverage constituents, and a conduit interposed between the first and second apertures and adapted to mix the plurality of beverage constituents. A dispensing nozzle is engaged with the second aperture, and a sensor device is disposed along the conduit, proximal to the second aperture, which is adapted to adjust the supply of a beverage constituent. Other dispensers are disclose in U.S. Pat. Nos. 3,217,931; 3,643,688; and 9,272,817. Each of these references can be incorporated by reference for all that they teach.

SUMMARY

Embodiments of the present disclosure can include a dispensing apparatus. The dispensing apparatus can include a tube including a dispensing end, a first outlet formed in the dispensing end of the tube, an annular wall positioned around the tube, and a second outlet defined by the annular wall and an exterior of the tube. An interior of the tube can be in fluid communication with a first liquid chamber. The exterior of the tube can be in fluid communication with a second liquid chamber. When a first liquid is conveyed from the first liquid chamber to the first outlet, the first liquid can form an internal liquid stream. When a second liquid is conveyed from the second liquid chamber to the second outlet, the second liquid can form an annular liquid column around the internal liquid stream. The first and second liquids can be conveyed to their respective outlets simultaneously.

In an embodiment, a dispensing assembly is disclosed. The dispensing assembly includes a first element defining a first outlet through which a first liquid is dispensed. The dispensing assembly further includes a second element defining a second outlet through which a second liquid is dispensed. The first liquid can form an internal liquid stream when dispensed through the first outlet. The second liquid can form an annular liquid column around the internal liquid stream when dispensed through the second outlet.

In another embodiment, the first element can include a cylindrical wall defining a tube through which the first liquid passes to the first outlet. The cylindrical wall of the first element can be positioned at least partially within the second outlet of the second element. In some cases, the cylindrical wall can extend beyond a bottom surface of the second element.

In another embodiment, one or more apertures can be defined through the cylindrical wall of the first element. The cylindrical wall can separate the first and second liquids. In this regard, the one or more apertures are arranged to limit passage of the second fluid toward the first outlet when the second fluid exhibits a dispensing pressure. The one or more apertures can be further arranged to allow passage of the second fluid toward the second outlet when the second fluid exhibits a cleaning pressure that is greater than the dispensing pressure.

In another embodiment, a dispensing assembly is disclosed. The dispensing assembly includes a first liquid chamber and a second liquid chamber. The dispensing assembly further includes a first outlet in fluid communication with the first liquid chamber and through which a first liquid is dispensed. The dispensing assembly further includes a second outlet in fluid communication with the second liquid chamber and through which a second liquid is dispensed. The dispensing assembly further includes an internal wall at least partially separating the first and second liquid chambers and at least partially defining the first and second outlets. The first liquid can form an internal liquid stream when dispensed through the first outlet. Further, the second liquid can form an annular liquid column around the internal liquid stream when dispensed through the second outlet.

In another embodiment, the dispensing assembly can further include a tube defining the internal wall and including a dispensing end defining the first outlet and a chamber end fluidically coupled with the first chamber. The dispensing assembly can further include an annular wall at least partially defining the second chamber and positioned around the tube, thereby defining the second outlet.

In another embodiment, the internal wall can extend beyond a lowermost bottom surface of the annular wall. In this regard, the internal wall can taper toward the first outlet. The dispensing assembly can further include one or more apertures defined through the internal wall to selectively connect the first and second liquid chambers. In this regard, the one or more apertures can be arranged for, at a first cleaning pressure, flow of the second liquid toward the first outlet. Further, the one or more apertures can be arranged for, at a second dispensing pressure that is less than the first cleaning pressure, restriction of the second liquid toward the first outlet.

In another embodiment, the internal liquid stream and the annular liquid column converge at a location downstream of both the first outlet and the second outlet. In some cases, the location can be spaced at a first distance from the first outlet, and the location is spaced at a second distance from the second outlet. As such, the second distance can be greater than the first distance.

In another embodiment, a method of dispensing a beverage is disclosed. The method includes directing a first liquid out of a first outlet. The first outlet can be located at a dispensing end of a tube and the first liquid can form an internal fluid stream as the first liquid exits the first outlet. The method further includes directing a second liquid out of a second outlet. The second outlet can be formed at least partially by an exterior surface of the tube and the second liquid can form an annular liquid column that surrounds the internal fluid stream as the second liquid exits the second outlet. The tube can protrude out of the second outlet.

In another embodiment, the method further includes flooding the tube with the second liquid by increasing a fluid pressure of the second liquid. The first liquid can include a flavoring medium. The second liquid can include a carbonated liquid. In some cases, the method can further include applying a flow rate that causes the internal fluid stream and the annular liquid column to converge at a distance away from the first outlet and the second outlet.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present disclosure as defined in the claims is provided in the following written description of various embodiments of the claimed subject matter and illustrated in the accompanying drawings.

Figure 1:
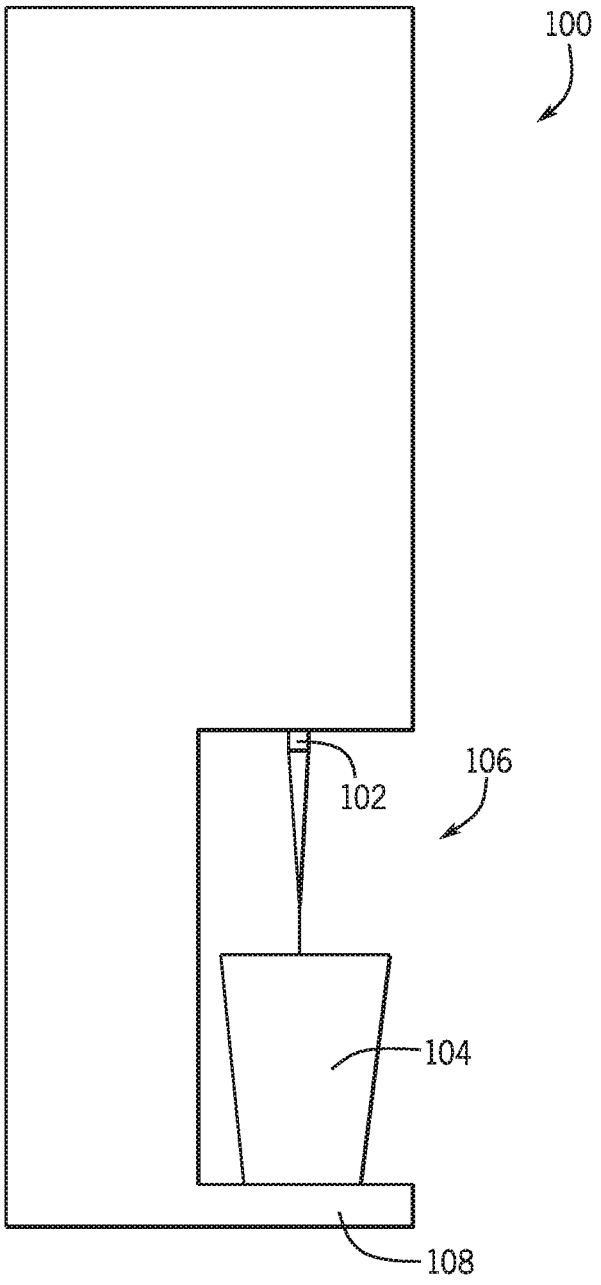
FIG. 1 is a schematic representation of an appliance in accordance with aspects of the present disclosure.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, can not necessarily be presented or illustrated to scale, and are not intended to indicate any preference or requirement for an illustrated embodiment to the exclusion of embodiments described with reference thereto.

DETAILED DESCRIPTION

An appliance can be used to prepare beverages. In some examples, the appliance is a brewing machine that prepares beverages like coffee, tea, hot chocolate, cider, and the like. In other examples, the appliance is a machine used to mix the ingredients for carbonated drinks, fruit drinks, milk products, alcoholic drinks, other types of drinks, or combinations thereof.

The appliance can include a dispenser that is in communication with a first liquid chamber and a second liquid chamber. The first liquid chamber and the second liquid chamber can include different types of liquids, or constituents of the desired final beverage. For example, one of the liquid chambers can contain water, carbonated water, milk, or another type of base liquid, while the other chamber includes a flavoring agent. The flavoring agent can include a concentrate, a syrup, a supplement, a dye, another type of flavoring agent, or combinations thereof. These different types of liquids can be separated from each other before the user instructs the appliance to dispense the beverage.

In response to user instructions to dispense the beverage, liquid from each of the first liquid chamber and the second liquid chamber can be dispensed out of the appliance simultaneously. The first liquid can be dispensed out of a first outlet, and the second liquid can be dispensed out of a second outlet.

The first outlet can be incorporated into a tube that is in fluid communication with a first liquid chamber. The tube can include a chamber end that receives the first liquid. A dispensing end of the tube can be opposite of the chamber end, and the first outlet can be defined in the dispensing end. As the first liquid exits the dispensing end of the tube, the first liquid can form a liquid stream that is directed to a container, such as a cup.

The second outlet can be formed by a wall that directs the second liquid towards the outside exterior of the tube. An opening in the wall can collectively form a second outlet with the exterior side of the tube. Thus, the dispensing end of the tube can protrude beyond the second outlet. As a result, the second outlet forms a ring-like shape through which the second liquid is dispensed. As the second liquid exits the appliance through the second outlet, the second liquid forms an annular liquid column that surrounds the internal liquid stream of the first liquid.

With the internal fluid stream surrounded by the annular fluid column, the internal fluid stream may not be visible to an observer looking in from the outside because the internal liquid stream is obscured by the annular liquid column. Initially, as the liquid stream and the annular liquid column exit from the dispenser, a gap can exist between them. As the distance from the dispenser increases, the annular liquid column can converge on itself. The annular liquid column can converge towards a central region as the liquids progressively move away from the dispenser until the annular liquid column intersects the internal liquid stream. The interaction between the internal liquid stream and the annular liquid column causes the two liquids to mix in the air within the ambient environment outside of the appliance.

By mixing the first liquid and the second liquid outside the appliance, the appliance can be simplified without needing a mixing chamber. This simplifies the construction and lowers the cost of the appliance. Another advantage of mixing the first liquid and the second liquid outside of the appliance is an ability to control the amount of turbulence between the two liquids as they mix. In cases where the second liquid includes carbonation, mixing the two liquids together can result in the carbonation forming bubbles during mixing that causes the carbonation to exit the liquids before the liquids enter into a user's cup. With the system described in this disclosure, the amount of turbulence can be controlled by varying the flow rate of the first and second liquids. By controlling the flow rates, and therefore the degree of turbulence during mixing, the carbonation can be preserved within the liquids.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1 depicts an example of an appliance 100 that is used to make beverages, such as the appliances discussed above and described in greater detail below. The appliance 100 can include a dispensing assembly 102 operable to dispense a beverage. In one example, the dispensing assembly 102 can dispense a beverage into a container 104, such as a cup, a mug, a bottle, or the like. Depending the particular application, the appliance 100 can include a dispensing area 106, such as a cavity or recess defined within the appliance 100 adjacent to the dispensing assembly 102. In such examples, the container 104 can be positioned within the dispensing area 106 to dispense the beverage into the container 104. For example, the container 104 can be positioned on a shelf 108 defined below the dispensing assembly 102. In some examples, the dispensing assembly 102 can be movable relative to the appliance 100. For instance, the dispensing assembly 102 can be extendable from the appliance 100 to facilitate dispensing of a beverage into the container 104. Such a configuration can allow dispensing of a beverage into a container 104 sized larger than the dispensing area 106, into a container 104 positioned remotely from the appliance 100, or the like.

The appliance 100 can be operable to dispense many beverages. Examples include coffee, tea, hot chocolate, cider, milk products, fruit drinks, soft drinks, alcoholic drinks, carbonated drinks, or the like, or any combination thereof. In particular, the appliance 100 is arranged to mix two or more ingredients together, such as reconstituting two or more independent beverage flows to make a desired beverage. In one example, the appliance 100 is operable to mix a first liquid 120 with a second liquid 122. As described more fully below, the first and second liquids 120, 122 can be mixed at a position external to the appliance, such as at a position between the dispensing assembly 102 and the container 104.

Depending on the particular application, the first liquid 120 can be a flavoring medium or concentrate, such as concentrated syrup or other ingredients. In some examples, the first liquid 120 can include concentrated alcohol, coloring dyes, flavor, or the like, or any combination thereof. The second liquid 122 can be added to dilute the first liquid 120 to a desired concentration. For example, the second liquid 122 can be water, carbonated liquid, alcohol, or milk, among others, or any combination thereof. Combining the first and second liquids 120, 122 can provide a desired characteristic of the resultant beverage. For instance, reconstituting the first and second liquids 120, 122 can provide a desired flavor, texture, look, and/or smell of the beverage.

The appliance 100 can include many configurations to facilitate reconstitution of the first and second liquids 120, 122. In some examples, the appliance 100 can include a pod receiver 124 (see FIG. 2) that holds a pod containing a beverage medium. The beverage medium can include ingredients used to make a certain type of beverage. In some cases, the beverage medium is the first liquid 120 or a constituent of the first liquid 120. The pod can be placed into the pod receiver 124 when the user desires to prepare a beverage. The appliance 100 can use the contents of the pod to make a drink. For example, the pod can be punctured or otherwise opened within the pod receiver 124 to empty its contents into the pod receiver 124 for subsequent mixing with the second liquid 122. In other examples, the beverage medium can be poured directly or indirectly into the appliance, such as into a first fluid reservoir.

The second liquid 122 can be supplied to the appliance 100 in many ways. In one example, the second liquid 122 can be supplied to the appliance 100 by a user who can add the second liquid 122 into a second fluid reservoir of the appliance 100. In some cases, the second liquid 122 can be supplied to the appliance 100 through a plumbing connection, such as from a dedicated water supply of a building. In other examples, the second liquid 122 can be supplied from other sources. In some cases, the second liquid 122 is carbonated. In such examples, a carbonation canister can be attached to the appliance 100 to deliver carbon dioxide gas to the second liquid 122. Depending on the particular application, the carbonation can be added to the second liquid 122 prior to dispensing the second liquid 122 into the container 104. In alternative examples, the second liquid 122 can be pre-mixed with the carbonation and supplied to the appliance in the premixed state. Carbon dioxide, nitrogen, or another type of gas can be added to the first liquid 120 and/or the second liquid 122, such as inside the appliance 100 or prior to adding the liquids to the appliance 100.

Figure 2:
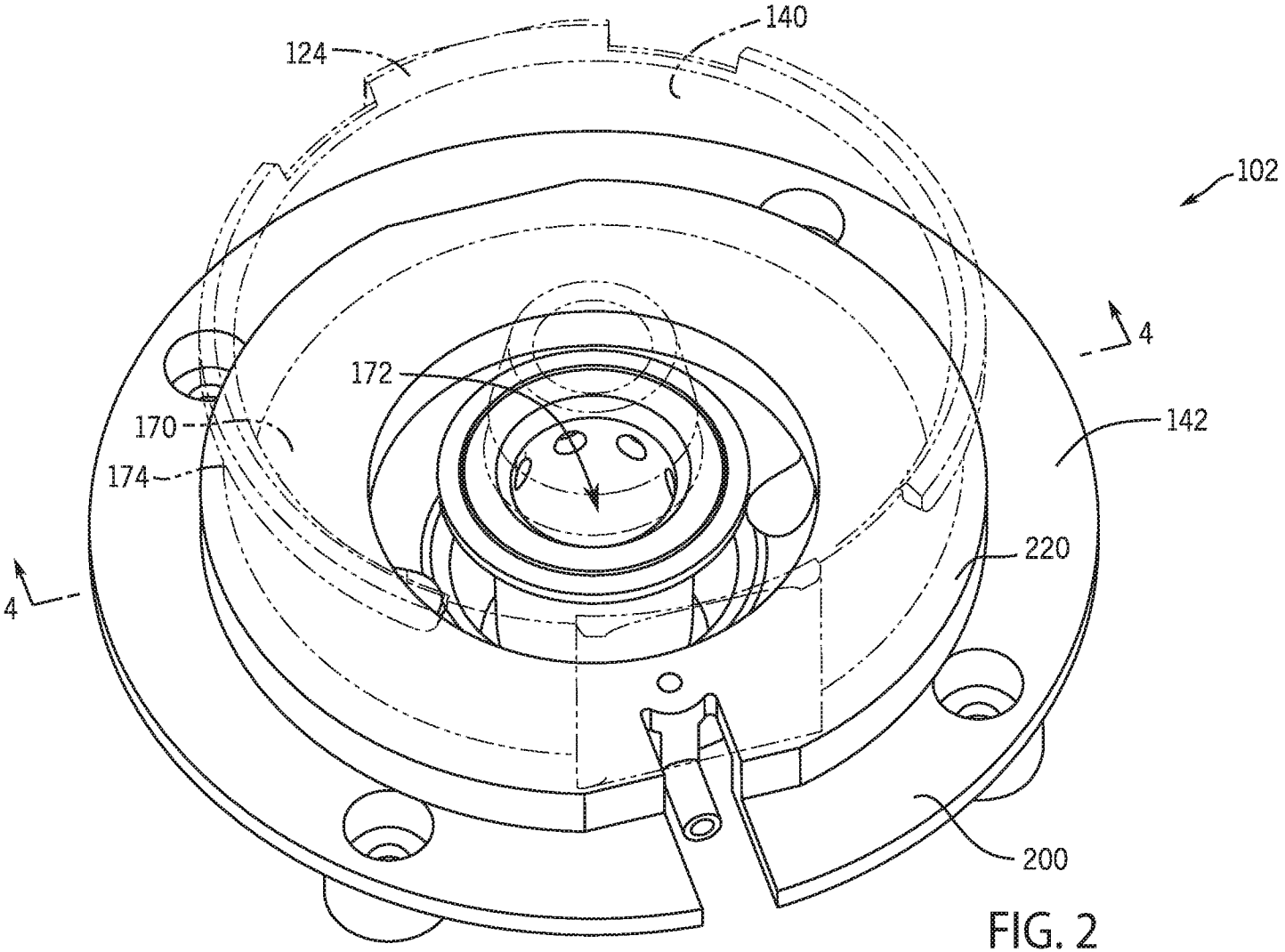
FIG. 2 is a top isometric view of a dispensing assembly in accordance with aspects of the present disclosure.
Figure 3:
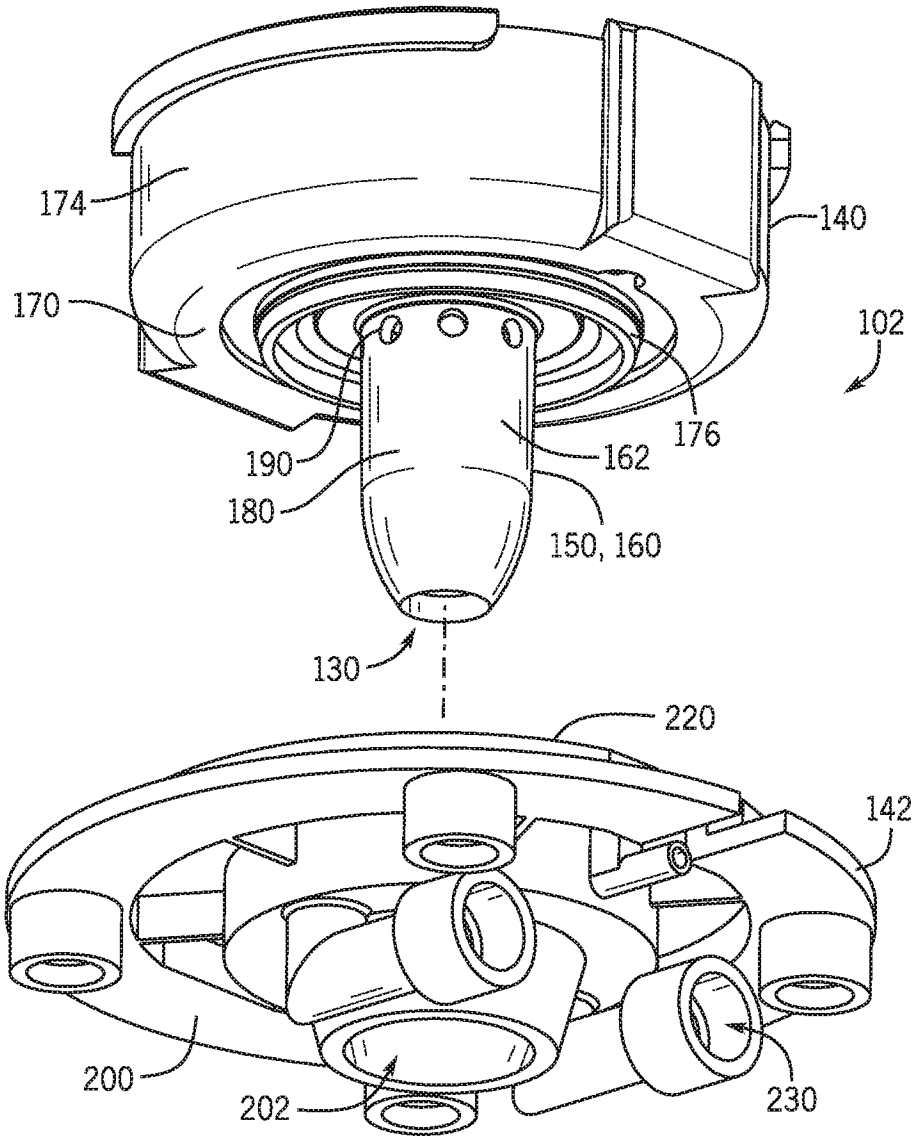
FIG. 3 is an exploded view of the dispensing assembly of FIG. 2.
Figure 4:
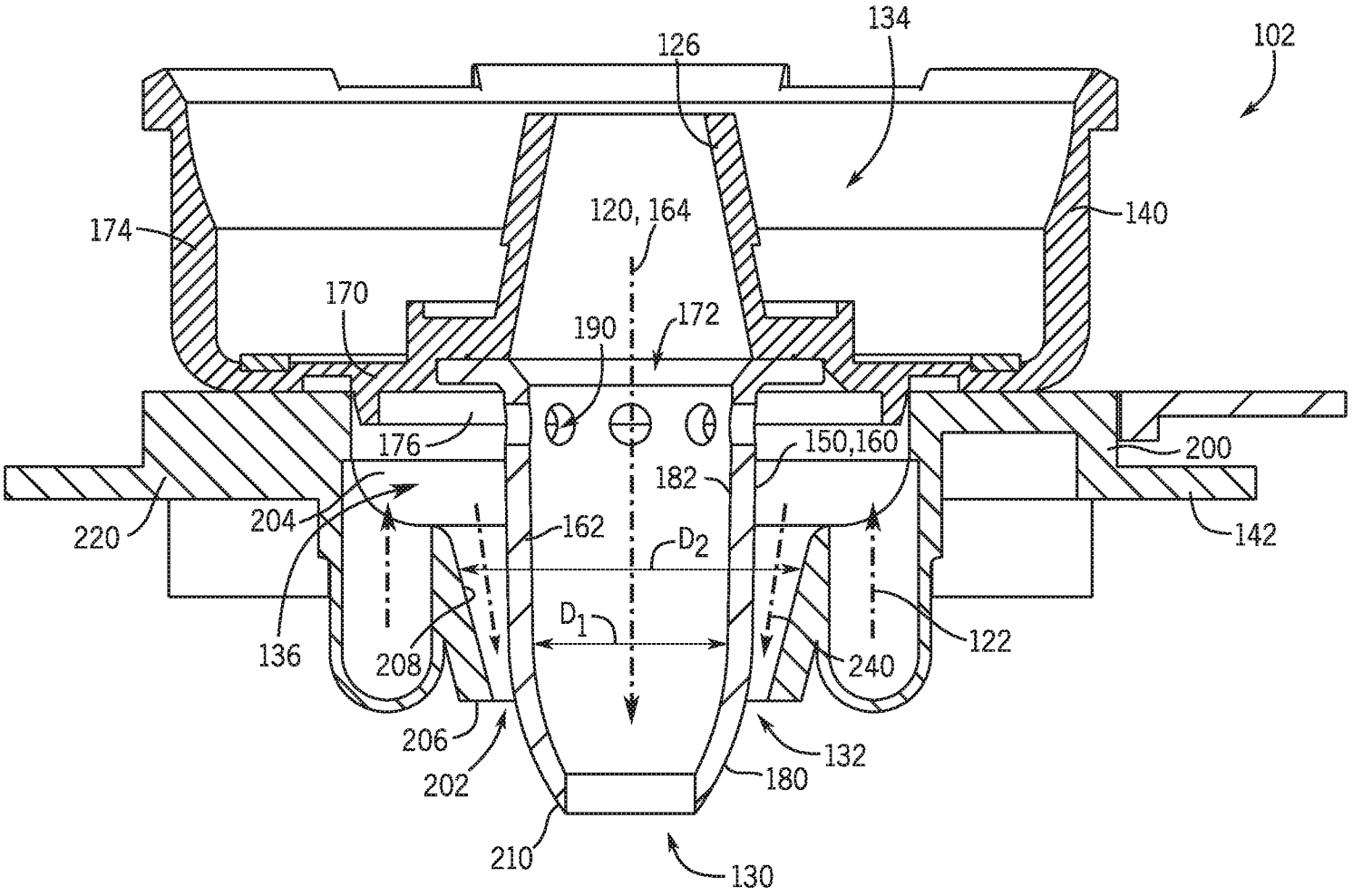
FIG. 4 is a cross-sectional view of the dispensing assembly of FIG. 2 taken along line 4-4 of FIG. 2.

FIG. 2 is an isometric view of the dispensing assembly 102. FIG. 3 is an exploded view of the dispensing assembly 102. FIG. 4 is a cross-sectional view of the dispensing assembly 102 taken along line 4-4 of FIG. 2. Referring to FIGS. 2-4, the dispensing assembly 102, which can be referred to as a dispensing apparatus, can be arranged to dispense the first and second liquids 120, 122 simultaneously or near simultaneously. As shown in FIG. 4, the dispensing assembly can include a first outlet 130 and a second outlet 132. The first outlet 130 can be in fluid communication with a first liquid chamber 134. The first liquid 120 can pass through the first liquid chamber 134 to be dispensed through the first outlet 130. The second outlet 132 can be in fluid communication with a second liquid chamber 136. The second liquid 122 can pass through the second liquid chamber 136 to be dispensed through the second outlet 132.

The first and second liquid chambers 134, 136, as well as the first and second outlets 130, 132, can be defined in many configurations. As one example, the dispensing assembly 102 can include first and second elements 140, 142 connected together to define the first and second liquid chambers 134, 136 and/or the first and second outlets 130, 132. For example, as shown in FIG. 4, the first and second elements 140, 142 can be connected together to define an internal wall 150 at least partially separating the first and second liquid chambers 134, 136 within the dispensing assembly 102. Additionally or alternatively, the internal wall 150 can at least partially define the first and second outlets 130, 132, as described in detail below.

The first element 140, which can be considered an inner or upper element, can define the first outlet 130 through which the first liquid 120 is dispensed. Referring to FIGS. 3 and 4, the first element 140 can include a cylindrical wall 160 defining a tube 162 through which the first liquid 120 passes to the first outlet 130. In such examples, the first liquid 120 can form a first liquid stream 164 when dispensed through the first outlet 130. The tube 162 can at least partially define the first liquid chamber 134. The cylindrical wall 160 can extend from a top wall 170 of the first element 140.

In such examples, an aperture 172 can be defined through the top wall 170, the aperture 172 being in fluid communication with the first liquid chamber 134. The cylindrical wall 160 of the first element 140 can at least partially define the internal wall 150 separating the first and second liquid chambers 134, 136 and/or defining the first and second outlets 130, 132. As such, any description with reference to the cylindrical wall 160 can apply to the internal wall 150, or vice versa. An annular flange 174 can extend from the top wall 170. The annular flange 174 and top wall 170 can define the pod receiver 124 arranged to hold a beverage pod. As shown, the annular flange 174 can extend in a direction opposite the cylindrical wall 160. The annular flange 174 can be concentrically aligned with the cylindrical wall 160, though other relationships are contemplated. In some examples, the first element 140 can include a post 126 arranged to pierce or puncture the pod such that the pod's contents are emptied into the pod receiver 124 and/or the tube 162 for subsequent dispensing through the first outlet 130. As shown, the post 126 can be in fluid communication with the tube 162, such as positioned above and concentrically aligned with the tube 162. In some examples, the first element 140 can include a seal 176 extending from or positioned adjacent to the top wall 170. The seal 176 can annularly surround at least a portion of the cylindrical wall 160. The seal 176 can be structure defined as part of the first element 140, or can be an O-ring or other sealing apparatus.

The cylindrical wall 160 of the first element 140 can include many configurations. As shown, the cylindrical wall 160 can include a circular cross-section, though other shapes are contemplated, including polygonal or elliptical, among others. The cylindrical wall 160 can include an exterior surface 180 and an interior surface 182. In such examples, the interior surface 182 of the cylindrical wall 160 can define a diameter $D_1$ of the first outlet 130.

Depending on the particular application, the diameter $D_1$ of the first outlet 130 can be between 2 and 8 millimeters. The diameter $D_1$ of the first outlet 130 can be sized to provide a consistent water cone formation. The diameter $D_1$ of the first outlet 130 can also be sized to limit the potential of the first liquid 120 fouling the exit surfaces of the first outlet 130 before the first liquid 120 exits the first outlet 130 and mixes with the second liquid 122. The cylindrical wall 160 can include a uniform or substantially uniform thickness such that the exterior and interior surfaces 180, 182 extend generally parallel to each other. In alternative examples, the thickness of the cylindrical wall 160 can vary, such as with distance away from the top wall 170. In one example, the cylindrical wall 160 can taper in diameter to the first outlet 130. In such examples, the cylindrical wall 160 can define a nozzle shaping the flow of the first liquid 120 through the first outlet 130.

In one example, one or more apertures 190 can be defined through the cylindrical wall 160. In such examples, the one or more apertures 190 can connect the exterior surface 180 of the cylindrical wall 160 or tube 162 with the interior surface 182 of the cylindrical wall 160 or tube 162. The one or more apertures 190 can be spaced at a distance away from the first outlet 130. For example, the one or more apertures 190 can be defined adjacent to the top wall 170 of the first element 140. In some examples, the one or more apertures 190 can be defined above the second outlet 132 of the dispensing assembly 102. As explained more fully below, the one or more apertures 190 can selectively connect the first and second liquid chambers 134, 136 to provide a desired functional characteristic. For example, at least a portion of the second liquid 122 can selectively pass through the one or more apertures 190 to be dispensed through the first outlet 130 for the purposes explained below.

With continued reference to FIGS. 2-4, the second element 142, which can be considered an outer or lower element, can define the second outlet 132 through which the second liquid 122 is dispensed. The second element 142 can include an annular wall 200 with an opening 202 therethrough to define the second outlet 132. The annular wall 200 can include a top shelf 204 and a bottom surface 206. A sidewall 208 can extend between the top shelf 204 and the bottom surface 206 to define the opening 202. The sidewall 208 can be sloped such that the opening 202 tapers in diameter to the second outlet 132. The sidewall 208 can define a diameter $D_2$ of the second outlet 132. The diameter $D_2$ of the second outlet 132 can be greater than the diameter $D_1$ of the first outlet 130. Depending on the particular application, the diameter $D_2$ of the second outlet 132 can be between 7.0 and 10.5 millimeters, such as between 8.5 and 9.0 millimeters. As shown in FIG. 4, the cylindrical wall 160 of the first element 140 can extend beyond the bottom surface 206 of the second element 142. For example, a dispensing end 210 of the cylindrical wall 160 can protrude between 3.0 and 5.0 millimeters beyond or below the bottom surface 206 of the second element 142.

The second element 142 can include a flange 220 extending from the top shelf 204 for connection with the first element 140. For instance, the flange 220 of the second element 142 can abut the top wall 170 of the first element 140 when the first and second elements 140, 142 are connected together. Depending on the particular application, the first and second elements 140, 142 can be releasably or permanently secured together. For instance, in one example, the seal 176 of the first element 140 can sealingly engage the flange 220 of the second element 142. The engagement between the seal 176 and the flange 220 can seal the second liquid chamber 136. The engagement between the seal 176 and the flange 220 can frictionally hold the first and second elements 140, 142 together such that the first element 140 is removable from the second element 142. In such examples, the first element 140 can be removed for cleaning, replacement, etc. In other examples, the first and second elements 140, 142 can be secured together by adhesive, fasteners, heat or sonic welding, or the like to limit disassembly of the dispensing assembly 102.

As shown in at least FIG. 3, the second element 142 can include one or more ports 230. In such examples, the second liquid 122 can be pumped through the one or more ports 230 for dispensing through the second outlet 132. In one example, the second liquid 122 can pass through the one or more ports 230 and discharged onto the top shelf 204 of the second element 142 (see FIG. 4). In such examples, the second liquid 122 can flow inwardly from the top shelf 204 and down the sidewall 208 of the second element 142 to form a second liquid stream 240 out the second outlet 132. Depending on the particular application, the flow of the second liquid 122 can be laminar along the top shelf 204 and sidewall 208. As described more fully below, the flow of the second liquid 122 can be limited such that the second liquid stream 240 forms an annular liquid column or ring when dispensed through the second outlet 132. Additionally or alternatively, the second liquid 122 can contact the exterior surface 180 of the cylindrical wall 160 of the first element 140 to define the annular liquid column. For instance, the second liquid 122 can contact the sidewall 208 of the second element 142 as well as the exterior surface 180 of the cylindrical wall 160 of the first element 140 to define a ring shape of the second liquid stream 240. In this manner, the cylindrical wall 160 of the first element 140 can be positioned at least partially within the second outlet 132 of the second element 142. In such examples, at least a portion of the exterior surface 180 of the cylindrical wall 160 or tube 162 can be disposed within the second outlet 132. As explained below, the second liquid stream 240 can annularly surround the first liquid stream 164 when the first and second liquids 120, 122 are first dispensed through the first and second outlets 130, 132.

Figure 5:
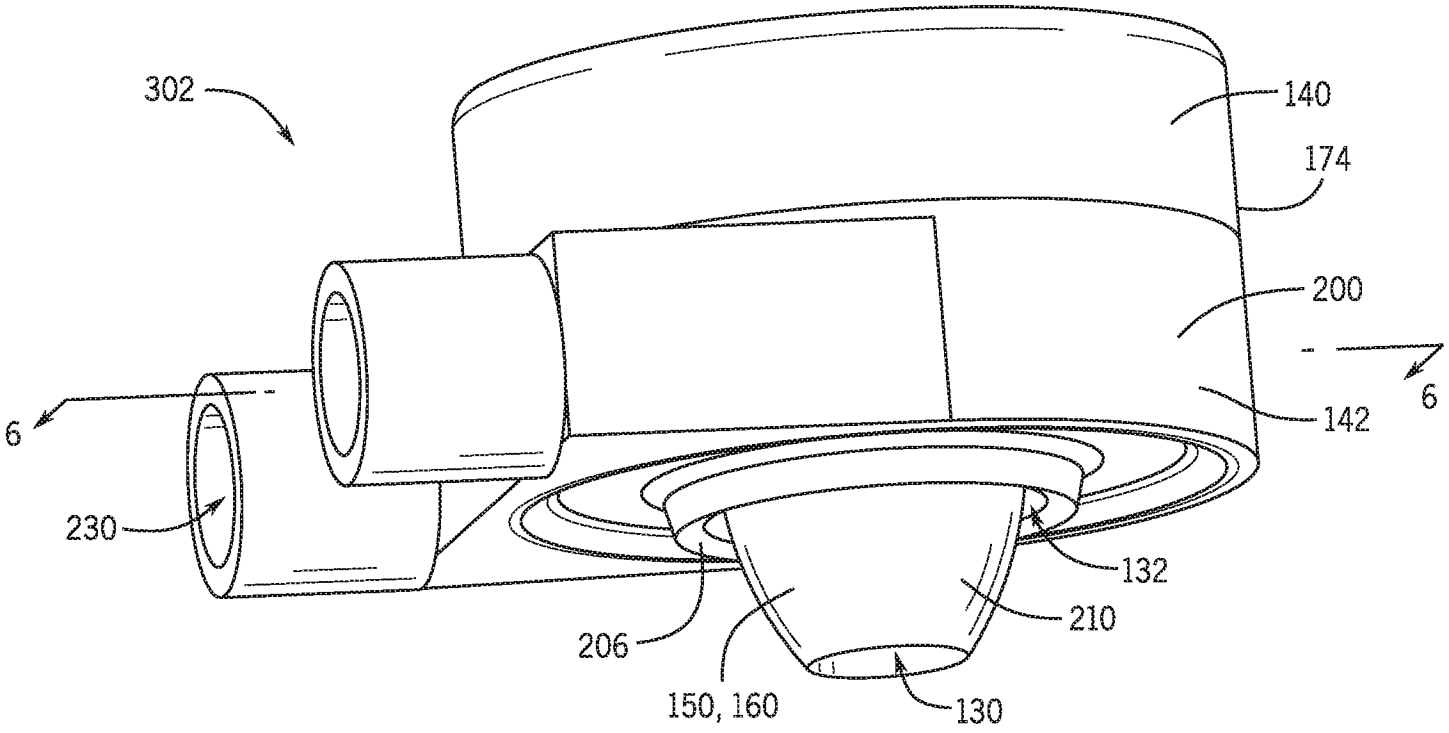
FIG. 5 is a bottom isometric view of an additional dispensing assembly in accordance with aspects of the present disclosure
Figure 6:
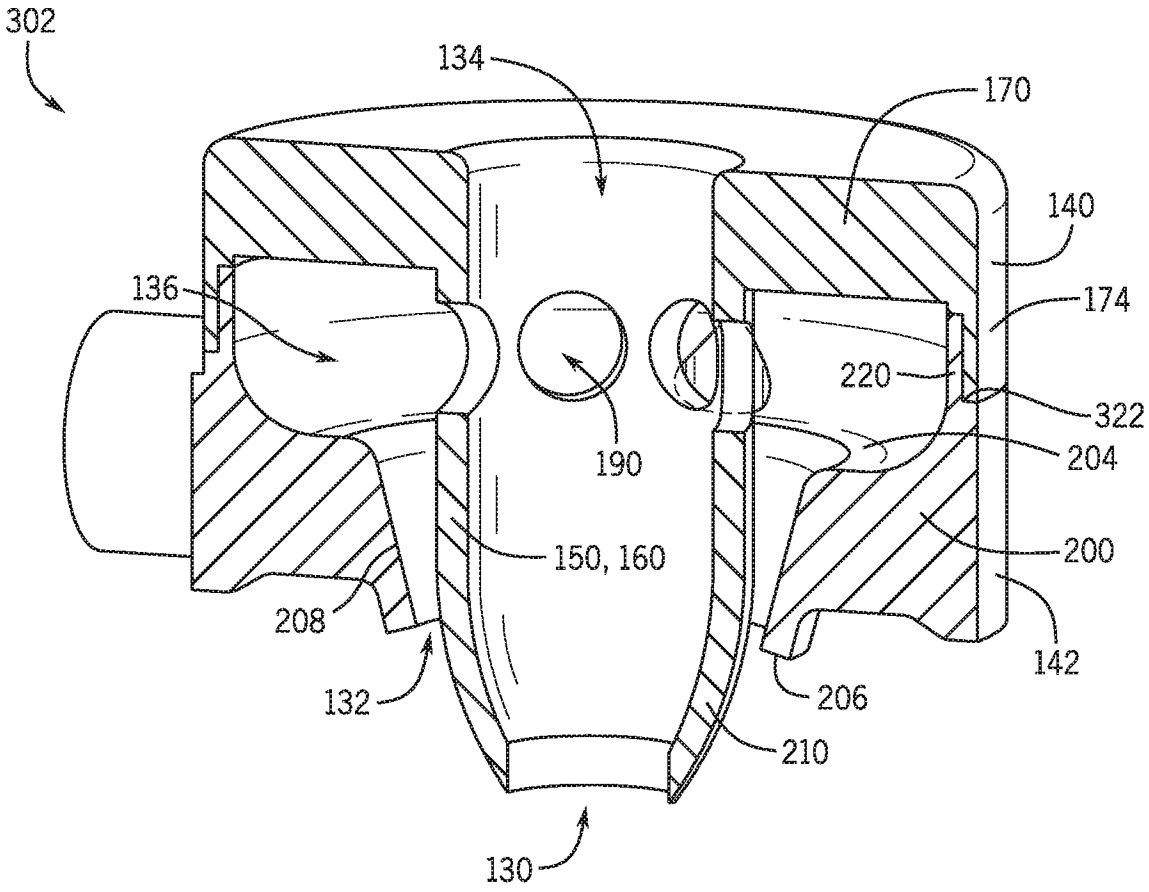
FIG. 6 is a cross-sectional view of the dispensing assembly of FIG. 5 taken along line 6-6 of FIG. 5.

FIG. 5 is an isometric view of an additional dispensing assembly 302 in accordance with aspects of the present disclosure. FIG. 6 is a cross-sectional view of the dispensing assembly 302 of FIG. 5 taken along line 6-6 of FIG. 5. In general, the dispensing assembly 302 is similar to the dispensing assembly 102 and its associated described above and thus, in certain instances, descriptions of like features will not be discussed when they would be apparent to those with skill in the art in light of the description above and in view of FIGS. 5 and 6. As such, any description above or below with reference to the dispensing assembly 102 can apply to the dispensing assembly 302, or vice versa. For ease of reference, like structure is represented with similar reference numbers.

Referring to FIGS. 5 and 6, the annular flange 174 of the dispensing assembly 302 can be arranged for connection with the flange 220 of the second element 142. For example, the flange 220 of the second element 142 can define a seat 322 in which the annular flange 174 of the first element 140 is seated when the first and second elements 140, 142 are connected together. As shown, the flanges 174, 220 of the first and second elements 140, 142 can be in abutting facing relationship when the first and second elements 140, 142 are connected together. For instance, the annular flange 174 of the first element 140 can be positioned about the flange 220 of the second element 142 for connection thereto. The engagement between the flanges 174, 220 can seal the second liquid chamber 136. Depending on the particular application, the flanges 174, 220 of the first and second elements 140, 142 can be releasably or permanently secured together. For instance, in one example, the flanges 174, 220 of the first and second elements 140, 142 can be frictionally held together such that the first element 140 is removable from the second element 142. In such examples, the first element 140 can be removed for cleaning, replacement, etc. In other examples, the flanges 174, 220 can be secured together by adhesive, fasteners, heat or sonic welding, or the like to limit disassembly of the dispensing assembly 102.

Figure 7:
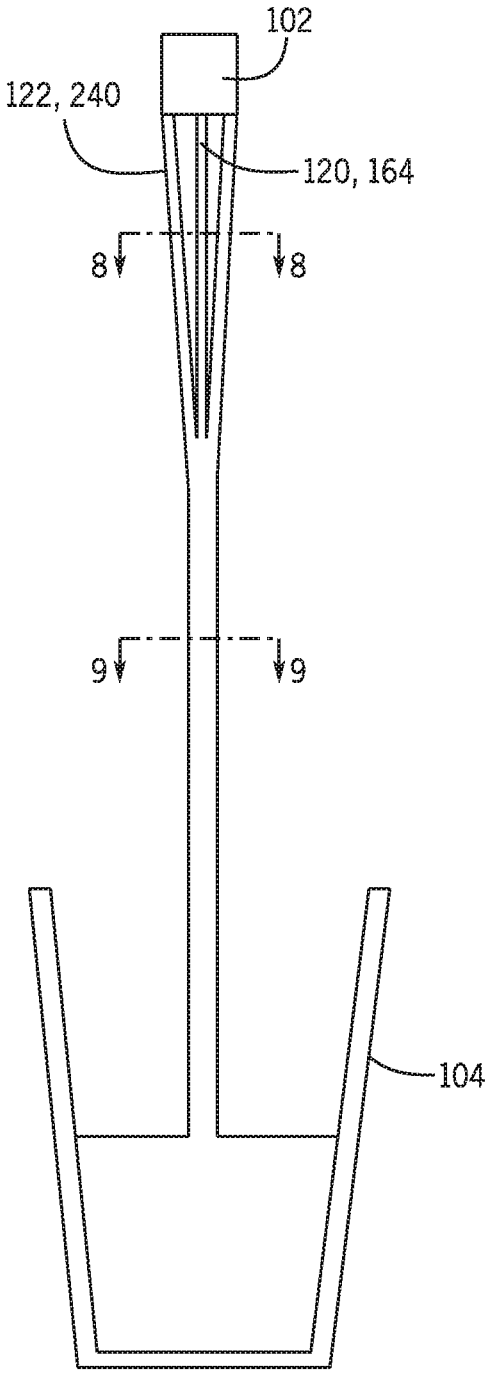
FIG. 7 is a schematic cross-sectional view of an example dispensing operation combining first and second liquids in accordance with aspects of the present disclosure.
Figure 8:
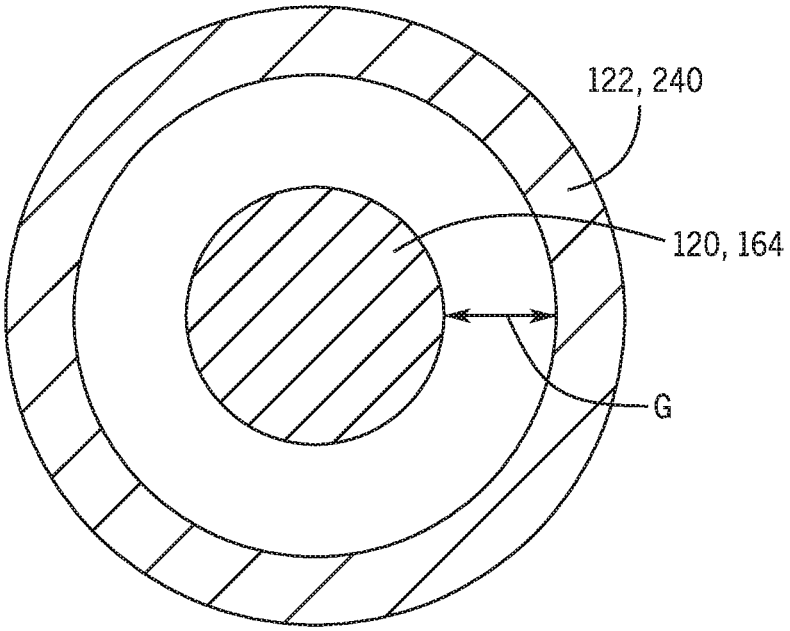
FIG. 8 is a cross-sectional view of the dispensing operation and taken along line 8-8 in FIG. 7.
Figure 9:
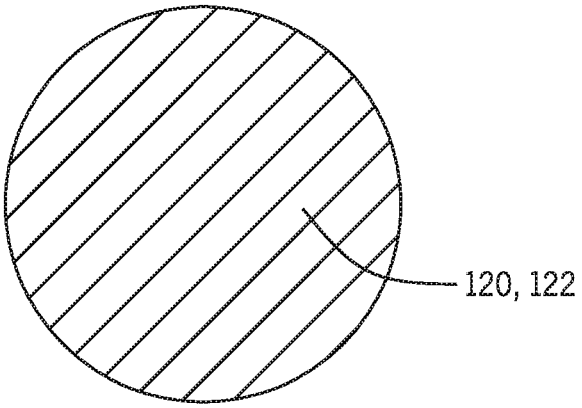
FIG. 9 is a cross-sectional view of the dispensing operation and taken along line 9-9 in FIG. 7.

FIG. 7 depicts an example of the first liquid stream 164 and the second liquid stream 240 converging after each is individually dispensed from the dispensing assembly 102. FIG. 8 is a cross-sectional view of the dispensed first and second liquids 120, 122 and taken along line A-A of FIG. 7. FIG. 9 is a cross-sectional view of the dispensed first and second liquids 120, 122 and taken along line B-B of FIG. 7. Referring to FIGS. 7 and 8, the first liquid 120 and the second liquid 122 are not mixed as they exit the dispensing assembly 102. Rather, the first liquid 120 and the second liquid 122 are separate and independent of one another when initially dispensed from the dispensing assembly 102. For example, a gap G can be defined between the inside diameter of the second liquid stream 240 and the outside diameter of the first liquid stream 164. While FIGS. 7 and 8 depict a gap between the first liquid stream 164 and the second liquid stream 240, in some examples a gap may not necessarily be discernible between each of the two liquids.

Referring to FIGS. 7 and 9, the first and second liquid streams 164, 240 can converge with distance away from the dispensing assembly 102, such as at a location outside of the dispensing assembly 102 and downstream of the first and second outlets 130, 132. In one example, the second fluid stream can converge on itself downstream of the first and second outlets 130, 132. More particularly, the tapering shape of the sidewall 208 of the second element 142 and/or the cylindrical wall 160 of the first element 140 can direct the second liquid stream 240 inwardly onto itself. As the second fluid stream converges on itself, the second fluid stream intersects the first fluid stream causing the two independent liquids to mix or reconstitute. In one example, the first and second liquid streams 164, 240 can converge into a heterogeneous but single liquid stream (see FIG. 9). Depending on the particular application, the first and second liquid streams 164, 240 can converge between 1 and 10 millimeters away from the dispensing assembly 102, such as between 1 and 3 millimeters below the bottom surface 206 of the second element 142. Convergence of the first and second liquid streams 164, 240 closely adjacent to the bottom of the dispensing assembly 102 can allow for a longer mixing time before the resultant beverage enter the container 104. However, it may not be desirable for the first and second liquid streams 164, 240 to mix while still in contact with the exit surfaces of the dispensing assembly 102 to limit potential fouling of the dispensing assembly 102. Due to the shape of the dispensing assembly 102, the first and second liquid streams 164, 240 can converge at a location spaced differently from the first and second outlets 130, 132. For example, the first and second liquid streams 164, 240 can converge at a location spaced at a first distance from the first outlet 130, the converging location also spaced at a second distance from the second outlet 132. Due to the protruding aspect of the tube 162 or cylindrical wall 160 of the first element 140 through the second outlet 132, the second distance can be greater than the first distance.

As noted above, the first liquid 120 and the second liquid 122 intersect and mix after they are dispensed from the appliance 100. Thus, the mixing occurs in an ambient environment outside of the appliance 100. This configuration limits bacterial growth within the dispensing assembly 102. This configuration can also allow the appliance 100 to dispense a beverage with desired properties. For example, as noted above, the second liquid 122 can be a carbonated liquid. Due to the carbonation in the liquid, the flow rate and/or the mixing of the first liquid 120 and/or the second liquid 122 can be adjusted or controlled to limit agitation of the carbonated second liquid 122. For instance, the degree of mixing can be controlled to limit the carbonation from being so agitated during mixing that the carbonation leaves the second liquid 122. To control the level of turbulence when mixing, the flow rate of the first liquid 120 and/or the second liquid 122 can be between 0.5 liters per minute and 1.5 liters per minute. In some examples, the flow rate can be between 0.75 liters per minute and 1.25 liters per minute. In some examples, the collective flow rate of both the first and second liquids 120, 122 can be about 1.0 liter per minute.

Additionally or alternatively, the diameter of the second fluid stream can be appropriately sized to achieve a desired convergence or mixing characteristic. In some examples, the diameter of the second fluid stream adjacent to the second outlet 132 can be between 8.5 millimeters and 9.0 millimeters. An annular liquid column with a diameter less than 8.5 millimeters can cause the mixing to be too turbulent between the first and second liquids 120, 122, which can disrupt the bonds in the carbon dioxide molecules resulting in less carbonation in the resulting beverage. An annular liquid column with a diameter larger than 9.0 millimeters may not maintain the integrity of the annular liquid column, thereby reducing the effectiveness of the mixing. For example, an annular liquid column with a diameter larger than 9.0 millimeters can result in a second fluid stream that does not completely annularly surround the first liquid stream 164. When the annular liquid column is compromised, the first liquid 120 is not fully contained or bracketed within the second fluid stream, thereby risking incomplete mixing of the fluids and/or exposure to the first liquid 120. Exposure to the first liquid 120 can result in splattering of the first liquid 120 outside of the dispensing area 106, which can be undesirable in embodiments where the first liquid 120 is a syrup.

As noted above, the configuration of the dispensing assembly 102 can limit bacterial growth. For example, the tube 162 of the first element 140 can be flooded with the second liquid 122 to rinse the first liquid 120 from the tube 162. Such a configuration can be desirable where the first liquid 120 is a syrup or other flavoring medium with ingredients prone to cause bacterial growth, such as high concentrations of sugar. In one example, the second liquid 122 can be applied at different fluid pressures depending on the operation state of the appliance 100. For instance, during normal dispensing operations, the second liquid 122 can be applied at a dispensing pressure. The dispensing pressure can be insufficient to raise the level of the second liquid 122 within the second fluid chamber to the one or more apertures 190 defined through the cylindrical wall 160 of the first element 140. As such, when the second fluid is applied at the dispensing pressure, the second fluid is limited to flowing through the second outlet 132 only.

During a cleaning operation of the appliance 100, the second liquid 122 can be applied at a cleaning pressure greater than the dispensing pressure. Unlike the dispensing pressure, the cleaning pressure can be sufficient to raise the level of the second liquid 122 within the second fluid chamber such that at least a portion of the second fluid flows through the one or more apertures 190 defined in the cylindrical wall 160 or tube 162 of the first element 140. In this manner, the second liquid 122 can pass through both the first and second outlets 130, 132. When flow of the first liquid 120 through the first outlet 130 is stopped, the second fluid can continue to flow through the one or more apertures 190 and out the first outlet 130 to flush the dispensing assembly 102 of the first liquid 120.

Figure 10:
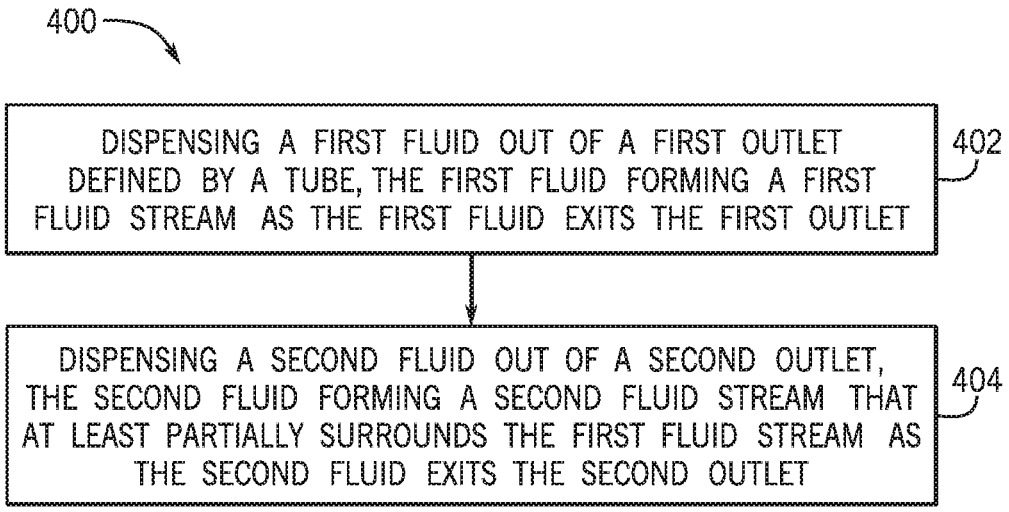
FIG. 10 is a flowchart illustrating an example method of dispensing a beverage in accordance with aspects of the present disclosure.

FIG. 10 is a flowchart illustrating an example method 400 of dispensing a beverage. Referring to FIG. 10, the method 400 can include directing or dispensing the first fluid out of the first outlet 130 (Block 402) and directing or dispensing the second fluid out of the second outlet 132 (Block 404). The first outlet 130 can be located at the dispensing end 210 of the tube 162. The second outlet 132 can be formed, at least in part, by the exterior surface 180 of the tube 162. Directing the first fluid out of the first outlet 130 can include forming the internal, first fluid stream as the first fluid exits the first outlet 130. Directing the second fluid out of the second outlet 132 can include forming the annular, second liquid stream 240 that surrounds the first liquid stream 164 as the second fluid exits the second outlet 132.

Figure 11:
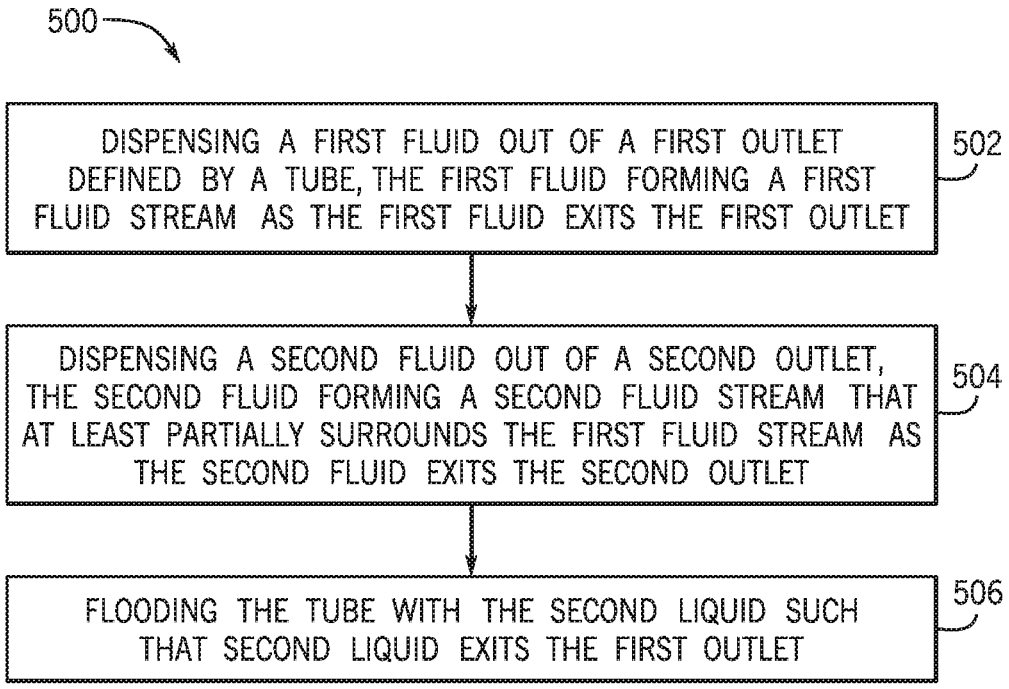
FIG. 11 is a flowchart illustrating another exemplary method of dispensing a beverage in accordance with aspects of the present disclosure.

FIG. 11 is a flowchart illustrating another exemplary method 500 of dispensing a beverage. Referring to FIG. 11, the method 500 can include directing or dispensing the first fluid out of the first outlet 130 (Block 502) and directing or dispensing the second fluid out of the second outlet 132 (Block 504). The first outlet 130 can be located at the dispensing end 210 of the tube 162. The second outlet 132 can be formed, at least in part, by the exterior surface 180 of the tube 162. Directing the first fluid out of the first outlet 130 can include forming the internal, first fluid stream as the first fluid exits the first outlet 130. Directing the second fluid out of the second outlet 132 can include forming the annular, second liquid stream 240 that surrounds the first liquid stream 164 as the second fluid exits the second outlet 132. In some examples, the method 500 can include flooding the tube 162 with the second liquid 122 (Block 506). The tube 162 can be flooded with the second liquid 122, increasing a fluid pressure of the second liquid 122. Flooding the tube 162 with the second liquid 122 can cause the second liquid 122 to reach a level at which the second liquid 122 enters the tube 162. For example, the level of the second liquid 122 can be raised such that at least a portion of the second liquid 122 passes through the one or more apertures 190 defined in the tube 162, at which point the second liquid 122 exits the first outlet 130, as explained above.

Figure 12:
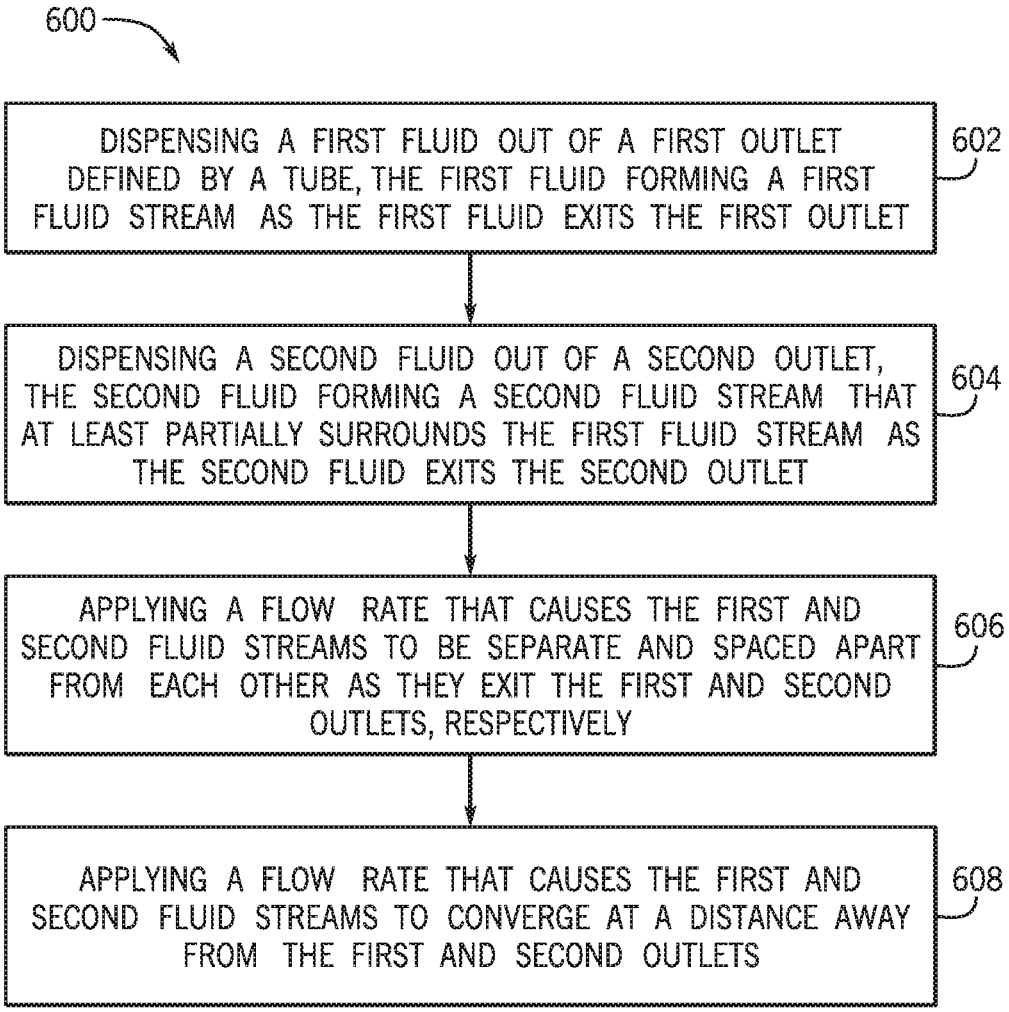
FIG. 12 is a flowchart illustrating another exemplary method of dispensing a beverage in accordance with aspects of the present disclosure.

FIG. 12 is a flowchart illustrating another exemplary method 600 of dispensing a beverage. Referring to FIG. 12, the method 600 can include directing or dispensing the first fluid out of the first outlet 130 (Block 602) and directing or dispensing the second fluid out of the second outlet 132 (Block 604). The first outlet 130 can be located at the dispensing end 210 of the tube 162. The second outlet 132 can be formed, at least in part, by the exterior surface 180 of the tube 162. Directing the first fluid out of the first outlet 130 can include forming the internal, first fluid stream as the first fluid exits the first outlet 130. Directing the second fluid out of the second outlet 132 can include forming the annular, second liquid stream 240 that surrounds the first liquid stream 164 as the second fluid exits the second outlet 132. In some examples, the method 600 can include applying a flow rate that causes the first and second fluid streams to be separate and spaced apart from each other as they exit the first and second outlets 130, 132, respectively (Block 606). In some examples, the method 600 can include applying a flow rate that causes the first and second fluid streams to converge at a distance away from the first and second outlets 130, 132 (Block 608).

The dispensing assembly 102 can be formed from a variety of materials and means. For example, portions of the dispensing assembly 102 can be formed from a thermoplastic material (self-reinforced or fiber reinforced), HDPE, ABS, polycarbonate, polypropylene, polystyrene, PVC, polyamide, and/or PTFE, among others. In some examples, the dispensing assembly 102 can be formed from aluminum or other similar metal. The dispensing assembly 102 can be coated with various surface treatments, such as a hydrophobic coating. The materials and/or surface treatments can be food grade. The dispensing assembly 102 can be formed or molded in any suitable manner, such as by plug molding, blow molding, injection molding, casting, or the like.

It should be noted that any of the features in the various examples and embodiments provided herein can be interchangeable and/or replaceable with any other example or embodiment. As such, the discussion of any component or element with respect to a particular example or embodiment is meant as illustrative only. In addition, it should be noted that the methods described above describe possible implementations, and that the operations and the steps can be rearranged or otherwise modified and that other implementations are possible. Furthermore, aspects from two or more of the methods can be combined.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, secured, joined, and the like) are to be construed broadly and can include intermediate elements between a connection of elements and relative movement between elements. As such, connection references do not necessarily infer that two elements are directly connected and in fixed relation to each other, unless specifically set forth in the claims.

The description herein is provided to enable a person skilled in the art to make or use the disclosure. Various modifications to the disclosure will be readily apparent to those skilled in the art, and the generic principles defined herein can be applied to other variations without departing from the scope of the disclosure. Thus, the disclosure is not limited to the examples described herein, but is to be accorded the broadest scope consistent with the principles and novel features disclosed herein.

What is claimed is:

1. A dispensing assembly comprising:

a first element defining a first outlet through which a first liquid is dispensed, the first element including a cylindrical wall defining a tube through which the first liquid passes to the first outlet; and a second element defining a second outlet through which a second liquid is dispensed;

wherein:

the first liquid forms an internal liquid stream when dispensed through the first outlet, the second liquid forms an annular liquid column around the internal liquid stream when dispensed through the second outlet, the first outlet is configured to form the internal liquid stream as being concentric with the annular liquid column, and the cylindrical wall of the first element is positioned at least partially within the second outlet of the second element and extends beyond a bottom surface of the second element; and wherein the first outlet is defind by a single opening of the first element.

2. The dispensing assembly of claim 1, wherein one or more apertures are defined through the cylindrical wall of the first element, the cylindrical wall separating the first and second liquids.

3. The dispensing assembly of claim 2, wherein the one or more apertures are arranged to:

limit passage of the second fluid toward the first outlet when the second fluid exhibits a dispensing pressure; and allow passage of the second fluid toward the second outlet when the second fluid exhibits a cleaning pressure that is greater than the dispensing pressure.

4. A dispensing assembly comprising:

first and second liquid chambers;

a first outlet in fluid communication with the first liquid chamber and through which a first liquid is dispensed;

a second outlet in fluid communication with the second liquid chamber and through which a second liquid is dispensed; and an internal wall at least partially separating the first and second liquid chambers and at least partially defining the first and second outlets;

wherein:

the first liquid forms an internal liquid stream when dispensed through the first outlet, the second liquid forms an annular liquid column around the internal liquid stream when dispensed through the second outlet, the internal liquid stream and the annular liquid column are concentric with one another upon exit from the dispensing assembly and converge at a location downstream of both the first outlet and the second outlets, and the location is spaced at a first distance from the first outlet, and the location is spaced at a second distance from the second outlet, the second distance being greater than the first distance; and wherein the first outlet is defined by a single opening.

5. The dispensing assembly of claim 4, further comprising a tube defining the internal wall and including a dispensing end defining the first outlet and a chamber end fluidically coupled with the first chamber.

6. The dispensing assembly of claim 5, further comprising an annular wall at least partially defining the second chamber and positioned around the tube, defining the second outlet.

7. The dispensing assembly of claim 6, wherein the internal wall extends beyond a lowermost bottom surface of the annular wall.

8. The dispensing assembly of claim 4, wherein the internal wall tapers toward the first outlet.

9. The dispensing assembly of claim 4, further comprising one or more apertures defined through the internal wall to selectively connect the first and second liquid chambers.

10. The dispensing assembly of claim 9, wherein the one or more apertures are arranged for:

at a first cleaning pressure, flow of the second liquid toward the first outlet; and at a second dispensing pressure that is less than the first cleaning pressure, restriction of the second liquid toward the first outlet.

11. A method of dispensing a beverage, comprising:

directing a first liquid out of a first outlet, the first outlet located at a dispensing end of a tube, the first liquid forming an internal fluid stream extending along a straight path as the first liquid exits the first outlet; and directing a second liquid out of a second outlet, the second outlet formed at least partially by an exterior surface of the tube, the second liquid forming an annular liquid column that substantially concentrically surrounds the internal fluid stream as the second liquid exits the second outlet;

wherein the tube protrudes out of the second outlet; and wherein the first outlet is defined by a single opening.

12. The method of claim 11, further including flooding the tube with the second liquid by increasing a fluid pressure of the second liquid.

13. The method of claim 11, wherein the first liquid includes a flavoring medium.

14. The method of claim 13, wherein the second liquid is a carbonated liquid.

15. The method of claim 11, further comprising applying a flow rate that causes the internal fluid stream and the annular liquid column to converge at a distance away from the first outlet and the second outlet.

16. A dispensing assembly comprising:

first and second liquid chambers;

a first outlet in fluid communication with the first liquid chamber and through which a first liquid is dispensed;

a second outlet in fluid communication with the second liquid chamber and through which a second liquid is dispensed;

an internal wall at least partially separating the first and second liquid chambers and at least partially defining the first and second outlets; and one or more apertures defined through the internal wall to selectively connect the first and second liquid chambers;

wherein:

the first liquid forms an internal liquid stream when dispensed through the first outlet, and the second liquid forms an annular liquid column around the internal liquid stream when dispensed through the second outlet.

17. The dispensing assembly of claim 16, wherein the one or more apertures are arranged for:

at a first cleaning pressure, flow of the second liquid toward the first outlet; and at a second dispensing pressure that is less than the first cleaning pressure, restriction of the second liquid toward the first outlet.

18. The dispensing assembly of claim 16, wherein the internal liquid stream and the annular liquid column converge at a location downstream of both the first outlet and the second outlets.

* * * * *